US006187737B1

(12) United States Patent
Geke et al.

(10) Patent No.: US 6,187,737 B1
(45) Date of Patent: Feb. 13, 2001

(54) LOW-FOAM DETERGENT COMPRISING A CATIONIC SURFACTANT AND A GLYCOL ETHER

(75) Inventors: Juergen Geke, Duesseldorf; Bernd Stedry, Kempen; Nicole Voeller, Meerbusch, all of (DE)

(73) Assignee: Henkel Kommanditgesellschaft auf Aktien, Duesseldorf (DE)

( * ) Notice: Under 35 U.S.C. 154(b), the term of this patent shall be extended for 0 days.

(21) Appl. No.: 09/445,162

(22) PCT Filed: May 29, 1998

(86) PCT No.: PCT/EP98/03223

§ 371 Date: Feb. 8, 2000

§ 102(e) Date: Feb. 8, 2000

(87) PCT Pub. No.: WO98/55578

PCT Pub. Date: Dec. 10, 1998

(30) Foreign Application Priority Data

Jun. 6, 1997 (DE) ..... 197 23 990

(51) Int. Cl.[7] ..... C11D 1/62; C11D 3/43

(52) U.S. Cl. ..... 510/245; 510/254; 510/255; 510/27.1; 510/365; 510/405; 510/432; 510/504; 510/506

(58) Field of Search ..... 510/245, 254, 510/255, 271, 365, 405, 432, 504, 506

(56) References Cited

U.S. PATENT DOCUMENTS

| | | | | |
|---|---|---|---|---|
| 4,814,108 | | 3/1989 | Geke et al. | 252/545 |
| 4,863,629 | | 9/1989 | Osberghaus et al. | 252/162 |
| 4,919,839 | * | 4/1990 | Durbut et al. | 252/153 |
| 5,529,713 | * | 6/1996 | Gauthier-Fournier | 252/106 |
| 5,585,341 | * | 12/1996 | Van Eenam | 510/365 |
| 5,714,453 | * | 2/1998 | Neumiller | 510/405 |
| 5,939,374 | * | 8/1999 | Richter et al. | 510/384 |
| 5,985,819 | * | 11/1999 | Lu et al. | 510/463 |

FOREIGN PATENT DOCUMENTS

| | | | |
|---|---|---|---|
| 36 20 011 | | 12/1987 | (DE) . |
| 40 14 859 | | 11/1991 | (DE) . |
| 41 02 709 | | 7/1992 | (DE) . |
| 0 054 895 | | 6/1982 | (EP) . |
| 0 116 151 | | 8/1984 | (EP) . |
| 0 261 874 | | 3/1988 | (EP) . |
| 275987 | * | 7/1988 | (EP) . |
| 257 987 | | 7/1988 | (EP) . |
| 0 288 856 | | 11/1988 | (EP) . |
| 0 691 397 | | 1/1996 | (EP) . |
| 691397 | * | 1/1996 | (EP) . |

OTHER PUBLICATIONS

Ullmanns Encyklopaedie der technischen Chemie, 4, 22 (1982) pp. 489–493 no Eng Xlation.

* cited by examiner

*Primary Examiner*—Yogendra Gupta
*Assistant Examiner*—Charles Boyer
(74) *Attorney, Agent, or Firm*—Wayne C. Jaeschke; Stephen D. Harper

(57) ABSTRACT

A cleaning agent concentrate is presented having (a) at least one glycol ether corresponding to the formula:

$$R—O—(CH_2—CH(CH_3)O)_n—H$$

where R is an alkyl group having 1 to 4 carbon atoms or a phenyl group, and n is a number of from 1 to 5; and (b) at least one cationic surfactant, where the weight ratio of (a) to (b) is from 8:1 and 100:1, and where the cleaning agent concentrate comprises less than 0.1 percent by weight of fatty alcohol alkoxylates, amphoteric surfactants, or mixtures thereof. When diluted to 0.5 to 5% by weight with water, a cleaning agent is formed that is low-foaming. The cleaning agent is especially useful for cleaning and passivating metal surfaces using a spray application.

14 Claims, No Drawings

LOW-FOAM DETERGENT COMPRISING A CATIONIC SURFACTANT AND A GLYCOL ETHER

This application is filed under 35 U.S.C 371 and based on PCT/EP98/03223, filed May 29, 1997.

BACKGROUND OF THE INVENTION

1. Field of the Invention

This invention relates to a cleaning agent for hard, particularly metallic, surfaces. It thus represents a so-called industrial cleaning agent, particularly a so-called neutral cleaning agent. Because of its particular combination of glycol ethers and cationic surfactants it is low-foaming and may therefore preferably be used as a spray cleaning agent over the entire temperature range of about 15 to about 80° C. relevant to the technical applications.

2. Discussion of Related Art

Such industrial cleaning agents are chiefly used in the car industry and its support industries for cleaning and passivating predominantly in spray cleaning units. They are suitable for the intermediate and final cleaning of components machined by cutting and non-cutting methods in body and assembly shops. Vitually all relevant materials, such as iron and steel, aluminum, silumin, copper, brass, zinc and plastics, may be treated and the majority of all organic or inorganic-based contaminants, such as cooling lubricants, rust prevention oils, machining oils, drawing auxiliary substances, pigments and light metal dust, may be removed. Such cleaning agents may also be used in conventional dip processes, although the use thereof in the spray process is conventionally preferred.

The chemical base components of such industrial cleaning agents are conventionally surfactants and organic corrosion inhibitors. The latter ensure temporary corrosion protection during and after treatment. In addition, such cleaning agents generally contain substances which are capable of counteracting undesirable foaming. In most cases, the use of such foam-inhibiting additives is called for because the impurities which are detached from the substrates and build up in the cleaning baths act as foaming agents.

Furthermore, the use of so-called foam inhibitors may also be required because of the fact that the cleaning agents themselves contain constituents which may give rise to undesirable foaming under the specified working conditions, i.e. particularly in the case of spray processes, such as anionic surfactants or non-ionic surfactants which foam at the working temperature in question.

The use of fatty alcohol polyethylene glycol ethers, also known as fatty alcohol ethoxylates, as the surfactant component in washing and cleaning agents is known from "Ullmanns Encyklopädie der technischen Chemie", 4th edition, vol. 22 (1982), pages 489 to 493. Such addition products of ethylene oxide to fatty alcohols are not, however, suitable for use in spray processes alone as they foam considerably at application temperatures of from 15 to 80° C. It is also known to use fatty alcohol ethyoxylate/propoxylates as low-foaming wash raw materials; cf. the above-mentioned Ullmann volume, page 494, for example.

DE-A-36 20 011 describes cationic surfactants based on quaternary ammonium compounds and the use thereof in cleaning agents. The cationic surfactants are used in the alkaline pH range in addition to further cleaning agent constituents.

EP-A-0 116 151 describes a process for regenerating and/or recycling aqueous degreasing and cleaning solutions by addition of cationic surfactants or cationically modified polymers or mixtures thereof.

EP-A-0 054 895 describes a surfactant mixture of a non-ionic surfactant and a quaternary ammonium compound as cationic surfactant for cleaning hard surfaces. In the mixture the non-ionic surfactant content is 20 to 95 wt. %, that of the cationic surfactant 5 to 80 wt. %.

DE-A-40 14 859 describes a low-foaming surfactant combination for cleaning hard surfaces which comprises at least one quaternary ammonium compound as well as at least one alkyl polyethylene glycol mixed ether. These mixed ethers have either one acyclic alkyl or alkenyl group having 6 to 18 carbon atoms or one cyclic alkyl group having 5 or 6 carbon atoms. This surfactant combination may additionally contain alkyl ethoxylates or alkyl ethoxylate/propoxylates which have one alkyl or alkenyl group having 6 to 18 carbon atoms in each case.

A cleaning agent for gas turbine compressors which contains 4 to 95 wt. % of glycol ether, 0.1 to 14 wt. % of nonionic-surfactant, 0.01 to 6 wt. % of cationic surfactant and 0 to 95 wt. % of water is known from EP-A-275 987. EP-A-691 397 discloses an anti-microbial cleaning agent for hard surfaces which contains as solvent $C_{1-6}$-alkanol-$C_{3-24}$-alkylene glycol ethers, amphoteric and/or non-ionic surfactants, cationic surfactants, builders and water. DE-C-41 02 709 proposes an agent for degreasing metal surfaces which contains 15 to 30 wt. % of adducts of low alkylene oxides to fatty alcohols having turbidity points below 50° C., 0.5 to 3 wt. % of cationic surfactants and 10 to 20 wt. % of auxiliary solvents from the group of the $C_{2-5}$ alkanols and low glycol ethers in water.

Accordingly, agents are known which contain fatty alcohol ethoxylates, cationic surfactants and low glycols as solvents or solubilizers. The basis of the invention is the surprising finding that, with suitable combination of glycols and cationic surfactants, an outstanding cleaning effect is achieved without these agents additionally containing amphoteric surfactants or fatty alcohol alkoxylates which act like surfactants, such as ethoxylates or propoxylates. In this case, fatty alcohol alkoxylates are to be understood to mean alkoxylates of alcohols having at least 6 carbon atoms in the alkyl group according to the disclosure of EP-A-691 397.

In the application concentration of about 0.5 to about 5 wt. %, all sprayable surfactant systems exhibit a range of disadvantages:

1 . To ensure low-foaming, application takes place above the so-called turbidity point. The application solutions are accordingly rendered turbid by means of a dispersed, surfactant-rich phase. This surfactant-rich phase is easily separated off by means of conventional measures to prolong service life, such as skimmers, separators, centrifuges or membrane filtration, and is no longer available for the cleaning process.

2. The conventional non-ionic surfactant systems, such as fatty alcohol or fatty amine ethoxylates or propoxylates and the mixed ethers thereof are classified in water hazard class 2.

3. The non-ionic surfactants having good degreasing action, such as fatty alcohol ethoxylates having more than 4 moles of ethylene oxide or fatty amine ethoxylates having more than 5 moles of ethylene oxide, which do not have a turbidity point at the conventional application temperatures, foam to an extremely high degree and are not considered alone for spray applications, Rather, foam inhibitors, which make little or no contribution to the cleaning performance, must be added. To incorporate these foam inhibitors into the liquid cleaning agent concentrates, solubilizers, so-called hydrotropic substances, are often required in order to obtain clear concentrates. These solubilizers represent a further ballast which does not itself contribute towards the cleaning performance.

In contrast, an object of the invention is to provide a new substance combination with effective cleaning action which does not have the above-mentioned disadvantages. In particular, a new substance combination having active cleaning action is to be provided which provides clear, low-foaming and sprayable cleaning solutions in the temperature range of about 15 to about 80° C. which is relevant in practice, without needing additional foam inhibitors and solubilizers for this purpose.

DESCRIPTION OF THE INVENTION

This object is achieved by a cleaning agent concentrate, containing glycol ethers and cationic surfactants, characterized in that it contains less than 0.1 wt. % of fatty alcohol alkoxylates and/or amphoteric surfactants and that it contains:

(a) glycol ethers corresponding to the general formula:

$$R—O—(CH_2—CH(CH_3)O)_n—H,$$

wherein R represents an alkyl group having 1 to 4 carbon atoms or a phenyl group; and n represents a number of from 1 to 5; and (b) cationic surfactants;

in the weight ratio (a) to (b) between 8:1 and 100:1.

Those glycol ethers of the above-mentioned general formula wherein R represents an alkyl group having 1 to 4 carbon atoms or a phenyl group; and n represents a number of from 1 to 3 are preferred. Furthermore, it is preferred that the cleaning agent concentrate contains glycol ethers and cationic surfactants in the weight ratio (a):(b) between 8:1 and 25:1.

This cleaning agent concentrate preferably contains the glycol ethers (a) in the concentration range of from about 5 to about 200 g/l and the cationic surfactants (b) in the concentration range of from about 0.2 to about 25 g/l. The remainder is water or an aqueous solution of further active or auxiliary substances, particularly corrosion inhibitors.

Examples of glycol ethers which may be used according to the invention are tripropylene glycol monoethyl ether, dipropylene glycol-n-butyl ether, tripropylene glycol-n-butyl ether and propylene glycol-phenyl ether. Tripropylene glycol monomethyl ether and tripropylene glycol-n-butyl ether are preferably used.

The cationic surfactants (b) are preferably selected from quaternary ammonium compounds corresponding to the general formula:

$$R^1—(CHOH—CHR^2)_n—N^+R^3R^4R^5X^-$$

wherein $R^1$ represents a straight or branched alkyl group having 1 to 22 carbon atoms;

$R^2$ may represent hydrogen or a straight or branched alkyl group having 1 to 22 carbon atoms; the total number of carbon atoms in the groups $R^1$ and $R^2$ being from 10 to 22;

n=0 or 1;

$R^3$ and $R^4$ independently represent methyl, ethyl, 2-hydroxyethyl or hydroxypropyl;

$R^5$ represents alkyl groups having 1 to 12 carbon atoms, a benzyl group or alkylphenyl groups having 1 to 3 carbon atoms in the alkyl group; and wherein the total number of carbon atoms of the quaternary ammonium cation is at least 9 and at least one of the groups $R^1$ and $R^5$ has more than 4 carbon atoms; and $X^-$ represents halide, methyl sulfate or an anion of an aliphatic or aromatic organic acid having up to 15 carbon atoms.

Such cationic surfactants wherein $R^3$ and $R^4$ represent methyl and $R^5$ represents benzyl are preferably used.

Examples of such cationic surfactants are lauryl-dimethyl-benzylammonium salts or 2-hydroxydodecyl-dimethyl-benzylammoniuin salts. Examples of anions $X^-$in these salts which come into consideration are halides, particularly chloride, or anions of organic salts which form water-soluble salts with the quaternary ammonium ions. Examples of such organic anions are acetate, propionate, lactate or benzoate.

The use of such cationic surfactants, together with non-ionic surfactants, for low-foaming industrial cleaning agents is known from DE-A-40 14 859, for example, although in that case these cationic surfactants are combined with non-ionic surfactants having alkyl or alkenyl groups having at least 5, preferably 6 to 18 carbon atoms. In contrast, it is novel and surprising that the glycol ethers (a) may be used instead of these conventional non-ionic surfactants. As these have an alkyl group having only 1 to 4 carbon atoms, it is surprising that they exhibit any degreasing action at all. Compared with the non-ionic surfactants of the prior art they have the ecological advantage of being classified in water hazard class 1. Together with the cationic surfactants, in the application concentration of the cleaning agent concentrate in water of about 0.5 to about 5 wt. %, they form clear application solutions which are low-foaming in spray processes and the cleaning performance thereof is at least comparable with the traditional spray cleaning agents.

In principle, the cleaning agent concentrates according to the invention may be used for cleaning purposes in diluted aqueous application solution without further additives. As they are intended to be used predominantly for cleaning unlacquered metal surfaces, however, it is to be preferred that the cleaning agent concentrates additionally contain corrosion inhibitors. Preferably the concentration thereof in the concentrates is from about 100 to about 700 g/l. These corrosion inhibitors prevent corrosion of the cleaned bright metal components if these are not directly further processed, but are packed or stored in moist conditions, for example.

Alkanolamines may be used, for example, as corrosion inhibitors. Monoethanolamine, monoisopropanolamine, triethanolamine, triisopropanolamine or mixtures thereof are preferably used. It would also be possible to use dialkanolamines because of the outstanding corrosion protection action thereof, but the use of dialkanolamines is avoided nowadays for toxicological reasons (risk of nitrosamine formation).

Furthermore, the corrosion inhibitors may be selected from branched or unbranched, saturated or unsaturated aliphatic carboxylic acids having 6 to 10 carbon atoms and/or from aromatic carboxylic acids having 7 to 10 carbon atoms. At the desired conventional pH values of the so-called neutral cleaning agents, which are from about 6.5 to about 9, the carboxylic acids are largely present as anions. Alkali metal ions, such as sodium or potassium ions in particular, but preferably the cations of the alkanolamines mentioned above, are used as counterions with which the acids may be neutralized.

Examples of suitable carboxylic acids are caproic acid, octanoic acid, ethylhexanoic acid, heptanoic acid, isononanoic acid and benzoic acid or derivatives thereof, particularly 3-nitrobenzoic acid or 4-hydroxybenzoic acid.

As further auxiliary or active substances, the cleaning agent concentrates may contain: builder substances, such as orthophosphates, polyphosphates, silicates, borates, carbonates, polyacrylates and gluconates of alkali metals. To some extent these builder substances also have complexing properties and thus act as water softeners. Stronger complexing agents, such as 1-hydroxyethane-1, 1-diphosphonicacid or 2-phosphonobutane-1,2,4-tricarboxylicacid may be used instead or in addition. Ethylene diamine tetraacetates and nitrilotriacetates may also be used, but optionally cause problems with waste water treatment. To protect the cleaning agent concentrates and the application solutions produced therefrom from attack by organisms, biocides may be added if desired.

The cleaning agent characterized above represents a concentrate from which the ready-to-use cleaning solution may be prepared by dilution. In principle, it would be possible to produce the cleaning solution by dissolving the individual active components in water in the required concentration range. In the branch of industry in question, however, it is conventional for the manufacturer to supply concentrates which contain all active ingredients in the desired quantity ratio and from which the user may produce the ready-to-use cleaning solution simply by diluting with water. In this case, the concentrates are conventionally standardized so that they are used as an about 0.5 to about 5 wt. % aqueous solution, i.e. for use they are diluted with water in the ratio of about 1:200 to about 1:20. Accordingly, the invention also encompasses a ready-to-use aqueous cleaning agent which may be obtained by diluting the cleaning concentrate according to one or more of claims 1 to 7, as described in greater detail above, with water in the ratio 1:200 to 1:20. This aqueous cleaning agent is used in particular for degreasing metal components in spray installations, wherein a temperature in the range of from about 15 to about 80° C. and particularly from about 15 to about 30° C., is set for this purpose.

EXAMPLES

Example 1

Aqueous application solutions according to the invention and comparison solutions according to the prior art were compared as regards cleaning result, surfactant separation and foaming behaviour. To do this, cleaning agent concentrates were initially produced by mixing the individual components. For the application tests, these were diluted with water as described below.

Test Results

A basic cleaning agent formulation, which comprises 30% triethanolamine and 4% isononanoic acid and water as the balance up to 100%, is mixed with various "surfactants" and then subjected to a cleaning, surfactant separation and foam test (all percentages quoted are percentages, by weight).

Surfactants:

a) 5.0% tripropylene glycol monomethyl ether 0.5% 2-hydroxydodecyl-dimethyl-benzyl-ammonium-benzoate b) 5.0% coconut amine+12 EO c) 5.0% fatty alcohol $C_{12/14}$+3 EO+6 PO d) 5.0% octanol+4,5 EO-butylether with concentrated homologue distribution each topped up to 100% with condensed water.

| Surfactant mixture | a (as per invention) | b (comp.) | c (comp.) | d (comp.) |
|---|---|---|---|---|
| Cleaning result | ++ | ++ | — | — |
| Surfactant separation | ++ | ++ | — | — |
| Foaming behaviour | + | — | + | ++ |

++=very good cleaning, no surfactant separation, no foam
+=good cleaning, foam depth in spray process<=1.5 cm
=virtually no cleaning, considerable surfactant separation, considerable foaming

Example 2

Further aqueous application solutions according to the invention were tested with different glycol ethers e), f) and g):

Cleaning Agent Formulation 1.2 wt. % citric acid
1.5 wt. % isononanoic acid
10.4 wt. % boric acid
3.8 wt. % triethanolamine
11.2 wt. % monoethanolamine
2.0 wt. % glycol ether e), f) or g)
0.15 wt. % 2-hydroxydodecyl-dimethyl-benzyl-ammonium-benzoate (50% solution) remainder water.

Glycol Ethers e) dipropylene glycol-n-butyl ether
f) tripropylene glycol-n-butyl ether
g) propylene glycol-phenyl ether

Test Results

| Glycol ether | e | f | g |
|---|---|---|---|
| Cleaning result | ++ | ++ | + |
| Surfactant separation | ++ | ++ | ++ |
| Foaming behaviour | + | + | + |

DESCRIPTION OF THE TEST METHODS

1. Cleaning Test

St 1405 grade steel sheets are pre-cleaned with surfactant solution by hand and contaminated with lapping paste (original contamination from practical conditions). After 2 days' storage in the hot cabinet at 60° C., they are sprayed for 10 minutes with a 2% cleaning agent solution in a laboratory spray installation at 60° C. The surfaces are assessed visually and the residual contamination determined gravimetrically.

Very good cleaning means that >99% of the contamination was removed, virtually no cleaning means a result <70%.

2. Surfactant Separation

In a 1000 ml beaker (tall form), a 2% cleaning agent solution is prepared in water of 20° dH, stirred for 5 minutes on a magnetic stirrer at approx. 600 rpm and then stored in the hot cabinet for 24 hours at 60° C. with no bath movement. The appearance of the solution and the separation on the surface of the liquid are assessed.

Assessment criteria:

++=no discernible separation o=separation visible, solution distinctly turbid

−considerable separation, clear solution.

3. Foaming Behaviour 2 wt. % cleaning agent solutions in water with a hardness corresponding to 20° dH were produced from the concentrates according to formulations a to d. 10 l of this solution in each case were sprayed in a single-jet sprayer with a spray pressure of 5 bars for 60 minutes with temperatures of between about 30 and about 45° C. When the sprayer was operating the foam height was measured, which is defined as the height of the foam above the level of the liquid in the initial state.

The assessment is as follows:

++=no foam

+=foam height <1.5 cm o=foam height <4.0 cm

−=foam height <5.5 cm

−−= equipment switches itself off as foam height >5.5 cm.

As may be seen from the test results, the agents according to the invention offer distinct advantages compared with existing systems.

What is claimed is:

1. A cleaning agent concentrate comprising:

(a) at least one glycol ether corresponding to the formula:

$$R—O—(CH_2—CH(CH_3)O)_n—H$$

wherein R is an alkyl group having 1 to 4 carbon atoms or a phenyl group, and n is a number of from 1 to 5; and (b) at least one cationic surfactant, wherein the weight ratio of (a) to (b) is from 8:1 and 100:1, and wherein said cleaning agent concentrate comprises less than 0.1 percent by weight of fatty alcohol alkoxylates, amphoteric surfactants, or mixtures thereof.

2. The cleaning agent concentrate of claim 1 wherein in said glycol ether formula, n is a number of from 1 to 3.

3. The cleaning agent concentrate of claim 1 wherein the weight ratio of glycol ether (a) to cationic surfactant (b) is from 8:1 to 25:1.

4. The cleaning agent concentrate of claim 1 comprising 5 to 200 g/l of glycol ethers (a), and 0.2 to 25 g/l of cationic surfactants (b) in an aqueous solution.

5. The cleaning agent concentrate of claim 1 wherein the glycol ether comprises tripropylene glycol monomethyl ether, tripropylene glycol-n-butyl ether, or mixtures thereof.

6. The cleaning agent concentrate of claim 1 wherein said cationic surfactant (b) comprises at least one quaternary ammonium compound having the formula:

$$R^1—(CHOH—CHR^2)_n—N^+R^3R^4R^5X^-$$

wherein $R^1$ is a straight or branched alkyl group having 1 to 22 carbon atoms; $R^2$ is a hydrogen or a straight or branched alkyl group having 1 to 22 carbon atoms, wherein the total number of carbon atoms of groups $R^1$ and $R^2$ is from 10 to 22; n is 0 or 1; $R^3$ and $R^4$ independently of each other are methyl, ethyl, 2-hydroxyethyl, or hydroxypropyl; $R^5$ is an alkyl group having 1 to 12 carbon atoms, a benzyl group or an alkylphenyl group having 1 to 3 carbon atoms in the alkyl group; wherein the total number of carbon atoms in the quaternary ammonium cation is at least 9, and at least one of the groups $R^1$ and $R^5$ has more than 4 carbon atoms; and $X^-$ is a halide, methyl sulfate, or an anion of an aliphatic or aromatic organic acid having up to 15 carbon atoms.

7. The cleaning agent concentrate of claim 6 wherein $R^3$ and $R^4$ are methyl, and $R^5$ is benzyl.

8. The cleaning agent concentrate of claim 1 further comprising 100 to 700 g/l of corrosion inhibitors.

9. The cleaning agent concentrate of claim 8 wherein said corrosion inhibitors are selected from the group consisting of alkanolamines; branched or unbranched, saturated or unsaturated aliphatic carboxylic acids having 6 to 10 carbon atoms; aromatic carboxylic acids having 7 to 10 carbon atoms; or mixtures thereof.

10. The cleaning agent concentrate of claim 1 further comprising builders, biocides, complexing agents, or mixtures thereof.

11. An aqueous cleaning agent comprising the cleaning agent concentrate of claim 1 diluted with water in a weight ratio of concentrate to water of from 1:200 to 1:20.

12. A process for degreasing metal components comprising forming the aqueous cleaning agent of claim 1 and spraying said aqueous cleaning agent onto said metal components.

13. The process of claim 12 wherein the spraying occurs at from 15 to 80° C.

14. The process of claim 13 wherein the spraying occurs at from 15 to 30° C.

* * * * *

UNITED STATES PATENT AND TRADEMARK OFFICE

CERTIFICATE OF CORRECTION

PATENT NO. : 6,187,737 B1
DATED : February 13, 2001
INVENTOR(S) : Geke et al.

It is certified that error appears in the above-identified patent and that said Letters Patent is hereby corrected as shown below:

Column 8,
Line 2, delete “claim 1”, and insert therefor -- claim 11 --.

Signed and Sealed this

Tenth Day of June, 2003

JAMES E. ROGAN
*Director of the United States Patent and Trademark Office*